US007299894B2

(12) United States Patent
Kawahashi et al.

(10) Patent No.: US 7,299,894 B2
(45) Date of Patent: Nov. 27, 2007

(54) ACOUSTIC FLUID MACHINE

(75) Inventors: Masaaki Kawahashi, Saitama (JP); Tamotsu Fujioka, Yokohama (JP); Masayuki Saito, Cincinnati, OH (US)

(73) Assignee: Anest Iwata Corporation, Yokohama-shi, Kanagawa (JP)

( * ) Notice: Subject to any disclaimer, the term of this patent is extended or adjusted under 35 U.S.C. 154(b) by 336 days.

(21) Appl. No.: 10/884,388

(22) Filed: Jul. 2, 2004

(65) Prior Publication Data

US 2006/0000669 A1 Jan. 5, 2006

(51) Int. Cl.
*F01N 1/14* (2006.01)

(52) U.S. Cl. ..... 181/262; 181/250; 181/273; 181/276

(58) Field of Classification Search ..... 181/250, 181/262, 273, 276
See application file for complete search history.

(56) References Cited

U.S. PATENT DOCUMENTS 3,560,913 A * 2/1971 Copley ..... 367/141
4,969,425 A * 11/1990 Slee ..... 123/73 AA
5,020,977 A * 6/1991 Lucas ..... 417/322
5,117,788 A * 6/1992 Blaser ..... 123/193.6
5,319,938 A * 6/1994 Lucas ..... 62/6
5,515,684 A * 5/1996 Lucas et al. ..... 62/6
5,579,399 A * 11/1996 Lucas ..... 381/165
7,130,246 B2 * 10/2006 Kawahashi et al. ..... 367/143
7,252,178 B2 * 8/2007 Kawahashi et al. ..... 181/262
2005/0199439 A1 * 9/2005 Goenka et al. ..... 181/250

* cited by examiner

*Primary Examiner*—Michael Sherry
*Assistant Examiner*—Terrence R. Willoughby
(74) *Attorney, Agent, or Firm*—Davis Bujold & Daniels, P.L.L.C.

(57) ABSTRACT

An acoustic fluid machine includes an acoustic resonator, a valve device, a piston, and an actuator. The acoustic resonator has a larger-diameter base and a smaller-diameter upper end. The valve device is provided on the upper end of the acoustic resonator and has a sucking hole and a discharge hole. The piston is provided in the base of the acoustic resonator and has a surface such that the distance between the upper end of the acoustic resonator and the upper surface of the piston is substantially constant over the whole surface of the piston. The actuator is connected to the piston and reciprocates the piston at high speed axially with a very small amplitude so that a gas is sucked into the acoustic resonator via the sucking hole and discharged via the discharge hole by virtue of pressure fluctuations within the acoustic resonator.

3 Claims, 2 Drawing Sheets

ACOUSTIC FLUID MACHINE

BACKGROUND OF THE INVENTION

The present invention relates to an acoustic fluid machine for a gas, the machine utilizing acoustic resonance-based fluctuations in pressure amplitude.

There is a known acoustic fluid machine in which a piston is reciprocated by an actuator at high speed axially with a very small amplitude is provided in a larger-diameter base of an acoustic resonator, and a gas is sucked into the acoustic resonator and discharged therefrom via the smaller-diameter upper end by virtue of pressure fluctuations within the acoustic resonator accompanying the reciprocation of the piston.

This acoustic fluid machine utilizes fluctuations in the pressure amplitude of standing acoustic waves generated by resonance of a gas column inside the tube accompanying movement of the piston when the piston reciprocates axially with a very small amplitude, and comprises as an operating part only an actuator that causes the piston in the base of the acoustic resonator to reciprocate at high speed.

The acoustic fluid machine has a very simple structure, has the advantage that the possibility of malfunction is very small, and is expected to find wide application in the future.

However, in the above-mentioned acoustic fluid machine, desired intake and discharge actions are carried out by transmitting to the upper end sound waves generated on the surface of the piston, which has minute high speed vibrations, and in order to achieve an effective action it is necessary to minimize the interference of sound waves that reach to the upper end.

In order to do this, it is necessary to maximize the ratio of the length of the acoustic resonator to the diameter of the piston. That is, in order to obtain specified intake and discharge abilities efficiently, it is necessary to increase above a specified level the length of the acoustic resonator relative to the diameter of the piston.

However, for a given intended performance, if the length of the acoustic resonator is too large, its application is restricted, and the cost of production and installation becomes high.

SUMMARY OF THE INVENTION

In view of the disadvantages, it is therefore an object of the present invention to provide an acoustic fluid machine in which the length of the acoustic resonator relative to the diameter of the piston is minimized, thereby achieving an increase in its applicability and a reduction in the production cost.

In order to achieve the object, in accordance with the present invention, there is provided an acoustic fluid machine comprising an acoustic resonator having a larger-diameter base and a smaller-diameter upper end; a valve device provided on the upper end of the acoustic resonator, the valve device having a sucking hole and a discharge hole; a piston in the base of the acoustic resonator, the piston having an upper surface such that the distance between the upper end of the acoustic resonator and the upper surface of the piston is substantially constant over the whole surface of the piston; and an actuator connected to the piston to reciprocate the piston at high speed axially with a very small amplitude so that a gas is sucked into the acoustic resonator via the sucking hole and discharged via the discharge hole by virtue of pressure fluctuations within the acoustic resonator.

In accordance with the present invention, even if the piston has a very large diameter, since sound waves generated on the surface of the piston by vibration are concentrated effectively on the intake/discharge valve device at the upper end of the acoustic resonator, a high intake/discharge effect can be attained, and consequently it is possible to decrease the length of the acoustic resonator relative to the diameter of the piston.

BRIEF DESCRIPTION OF THE DRAWINGS

The features and advantages of the present invention will become more apparent from the following description with respect to embodiments as shown in appended drawings, wherein.

DETAILED DESCRIPTION OF PREFERRED EMBODIMENTS

Figure 1:
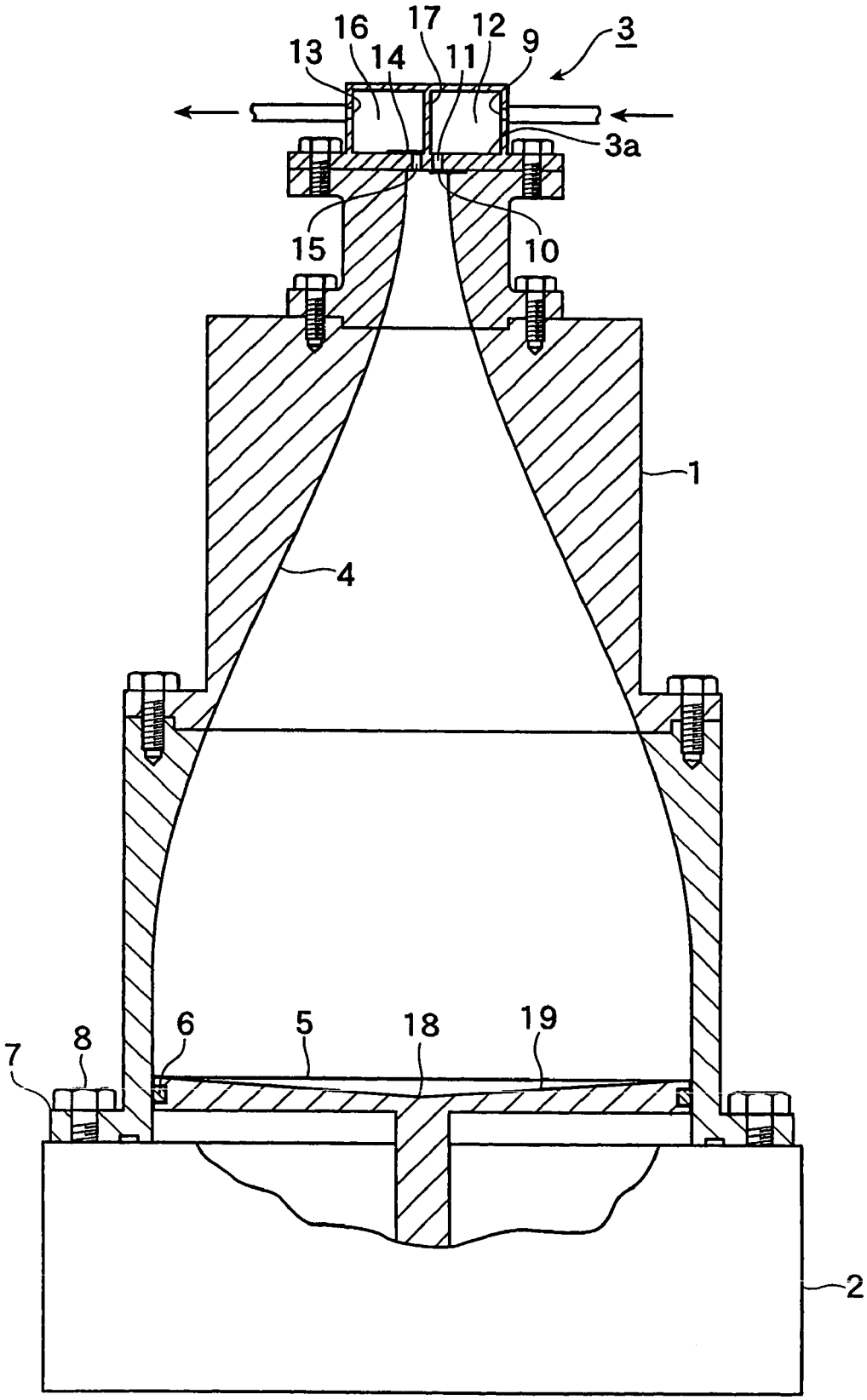
FIG. 1 is a vertical sectional view an embodiment of an acoustic fluid machine according to the present invention.

An acoustic fluid machine is formed by mounting an actuator 2 under the larger-diameter lower end at the base of an acoustic resonator 1, and a valve device 3 on the smaller-diameter upper end of the acoustic resonator 1.

The acoustic resonator 1 has a resonant cavity 4 having the larger-diameter lower end, and the diameter gradually decreases toward the top. The dimensions of the resonant cavity 4 are such that, for example, when the length from the lower end to the upper end is approximately 100, the diameter of the upper end is approximately 5 and the diameter of the lower end is approximately 35.

The actuator 2 functions also as a support platform, and reciprocates a piston 5 connected to the actuator 2. The piston 5 is made of light alloy and is fitted in the lower end of the resonant cavity 4, the outer periphery of the piston 5 being equipped with a seal 6.

An outer portion 19 of the surface of the piston 5 is inclined gradually upward from the center 18 thereof.

The acoustic resonator 1 has an outward flange 7 at the lower end, this outward flange 7 is superimposed on the upper surface of the actuator 2, and the outward flange 7 and the actuator 2 are secured to each other by means of an appropriate number of bolts 8.

The valve device 3, which is mounted on the upper end of the acoustic resonator 1, comprises a suction chamber 12 and a discharge chamber 16 that are arranged in line. The suction chamber 12 has an inlet 9 on one side of the valve device 3 and a sucking hole 11 for sucking external air through a bottom wall 3*a*, with an inward check valve 10, and the discharge chamber 16 has an outlet 13 on the other side of the valve device 3 and a discharge hole 15 for discharging pressurized air, through the bottom wall 3*a*, with an outward check valve 14.

The inward and outward check valves 10 and 14 are formed from a rubber sheet valve or a reed valve made of, for example, a thin steel sheet, and secured at one end to the lower surface of the bottom wall 3*a* of the suction chamber 12 and the upper surface of the bottom wall 3*a* of the discharge chamber 16, respectively. They may be of a ball type or any other type.

The valve-opening resistance of the outward check valve 14 is set to be considerably larger than that of the inward check valve 10.

The suction chamber 12 and the discharge chamber 16 are partitioned by a wall 17.

The drive frequency of the actuator 2 is controlled by a function synthesizer (not illustrated), and is adjustable to about 0.1 Hz.

When the piston 5 reciprocates with a very small amplitude axially in the larger-diameter base at the lower end of the acoustic resonator 1, and the pressure amplitude within the acoustic resonator 1 becomes a minimum accompanying this reciprocation, external air is sucked into the inlet 9, flows into the suction chamber 12, and is sucked into the acoustic resonator 1 via the sucking hole 11 and the inward check valve 10. When the pressure amplitude within the acoustic resonator 1 becomes a maximum, the air is discharged in a pressurized state from the interior of the acoustic resonator 1 via the discharge hole 15, the outward check valve 14, the discharge chamber 16, and the outlet 13.

As hereinbefore described, the valve-opening resistance of the outward check valve 14 at the discharge hole 15 is set to be considerably larger than that of the inward check valve 10 at the sucking hole 11.

Therefore, during the initial period of operation, air taken into the resonant cavity 4 via the sucking hole 11 and the inward check valve 10 by virtue of operation of the piston 5 is not discharged immediately via the discharge hole 15 by the subsequent operation of the piston 5, but after the pressure within the resonant cavity 4 increases to a specified level, the outward check valve 14 opens and the air is discharged via the discharge hole 15 and the outlet 13.

Therefore, in comparison with a device in which the two check valves 10 and 14 have an identical valve-opening resistance, the density of a gas sucked into the resonant cavity 4 by reciprocation of the piston 5 is higher, and consequently the discharge pressure and the discharge rate become large.

In an embodiment shown in FIG. 1, since the outer portion 19 is gradually inclined upward from the center 18 on the upper surface of the piston 5, sound waves generated by vibration of the piston 5 is directed inward or toward the upper end of the acoustic resonator 1.

Therefore, even when the diameter of the base of the acoustic resonator 1 is quite large, the sound waves are concentrated to the upper end, thereby enabling gas to be compressed effectively.

Reduction in length of the acoustic resonator 1 relative to the diameter of the piston 5 or the larger-diameter base of the acoustic resonator 1 allows suction and discharge to become efficient.

Figure 2:
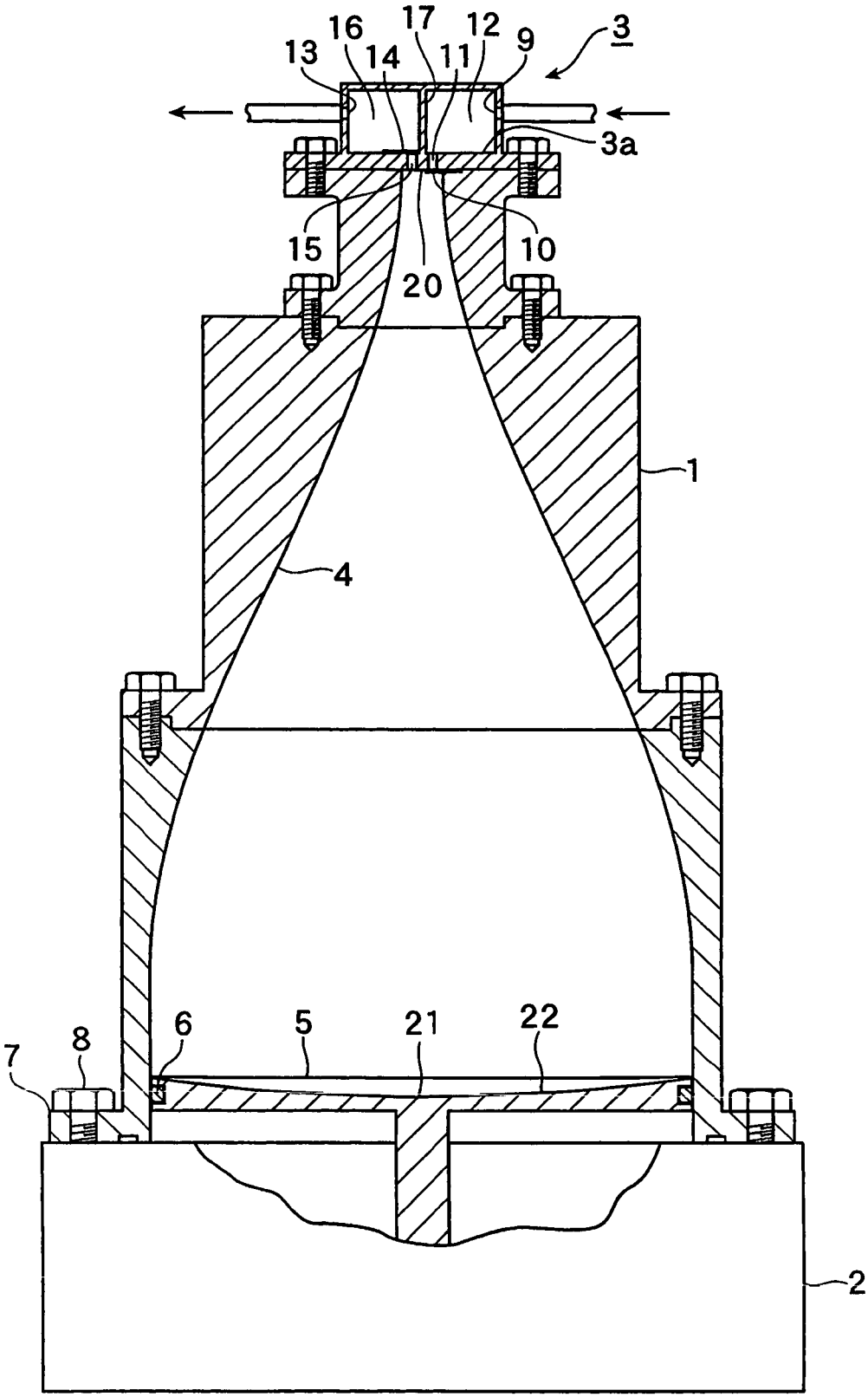
FIG. 2 is a vertical sectional view of another embodiment of an acoustic fluid machine according to the present invention.

FIG. 2 is a view corresponding to FIG. 1 of another embodiment of the present invention.

The acoustic fluid machine in FIG. 2 is similar to that in FIG. 1. The same numerals are allotted to the same members as those in FIG. 1 and its description is omitted. Only the differences will be described.

In FIG. 2, a piston 5 has a concave upper surface 22, which is part of a sphere having a radius that is a straight line connecting the center 20 of the upper end of an acoustic resonator 1 and the center 21 of the surface of the piston 5. The center of the sphere coincides with the center 20 of the upper end of the acoustic resonator 1.

Waves on the surface of the piston 5 can be concentrated to the center 20 of the acoustic resonator 1 with higher accuracy, thus enabling high efficiency to be obtained.

The concave surface 22 may be an elliptically curved surface.

The foregoing merely relates to embodiments of the present invention. Various modifications and changes may be made by a person skilled in the art without departing from the scope of claims wherein:

What is claimed is:

1. An acoustic fluid machine comprising:

an acoustic resonator having an internal resonant cavity having a larger-diameter base and a smaller-diameter upper end;

a suction chamber located on the upper end of the acoustic resonator and having an inlet and a sucking hole communicating with the resonant cavity:

a discharge chamber located on the upper end of the resonant cavity-and having an outlet and a discharge hole communicating with the resonant cavity;

a valve device including:

a sucking check valve device located with the sucking hole to permit a gas to be drawn into the resonant cavity, and a discharge check valve device located with the discharge hole to permit the gas to be drawn from the resonant cavity;

a piston in the base of the resonant cavity, the piston having an upper concave spherical surface having a radius of defined by a straight line connecting a center of the upper end of the resonant cavity and a center of the upper surface of the piston wherein a center of the spherical surface coincides with the center of the upper end of the resonant cavity such that distances between the upper end of the resonant cavity and the upper surface of the piston are substantially constant over the whole concave spherical surface of the piston; and an actuator connected to the piston to reciprocate the piston continuously axially at high speed with a very small amplitude to cause a corresponding succession of waves of increased and decreased pressure amplitude to travel from the piston to the upper part of the resonant chamber so that the gas is sucked into the resonant cavity via the sucking hole and discharged via the discharge hole by virtue of pressure fluctuations within the resonant cavity.

2. An acoustic fluid machine comprising:

an acoustic resonator having an Internal resonant caviW having a larger-diameter base and a smaller-diameter upper end;

a valve device located at the upper end of the resonant cavity and including an inlet check valve device for permitting a gas to be drawn into the resonant cavity and a discharge check valve device for permitting the gas to be drawn from the resonant cavity;

a piston in the base of the resonant cavity, and an actuator connected to the piston to continuously reciprocate the piston axially at high speed with a very small amplitude to cause a corresponding succession of pressure waves of increased and decreased pressure amplitude to be radiated from an upper concave spherical surface of the piston having a center of radius coincident with a center of the upper end of the resonant cavity so that the pressure waves are generally focused onto the center of the upper end of the resonant cavity, whereby the gas is sucked into the resonant cavity via the sucking hole and discharged via the discharge hole by virtue of pressure fluctuations within the resonant cavity.

3. An acoustic fluid machine comprising:

an acoustic resonator having an internal resonant cavity having a larger-diameter base and a smaller-diameter upper end;

a suction chamber located on the upper end of the acoustic resonator and having an inlet and a sucking hole communicating with the resonant cavity, a discharge chamber located on the upper end of the resonant cavity-and having an outlet and a discharge hole communicating with the resonant cavity, a valve device including provided on an upper end of the acoustic resonator, a sucking check valve located with the sucking hole to permit a gas to be drawn into the resonant cavity, a discharge check valve located with the discharge hole to permit the gas to be drawn from the resonant cavity, and the discharge check valve having a greater opening resistance than sucking check valve;

a piston in the base of the resonant cavity, the piston having an upper concave spherical surface which corresponds to a portion of a sphere having a radius defined by a straight line connecting a center of the upper end of the acoustic resonator and a center of the upper surface of the piston wherein a center of the spherical surface coincides with the center of the upper end of the resonant cavity such that distances between the upper end of the resonant cavity and the upper surface of the piston are substantially constant over the whole concave spherical surface of the piston; and an actuator connected to the piston to continuously reciprocate the piston axially at high speed with a very small amplitude so that the gas is sucked into the resonant cavity via the sucking hole and discharged via the discharge hole by virtue of pressure fluctuations within the resonant cavity.

* * * * *